United States Patent [19]

Harvey, Jr.

[11] 3,964,748

[45] June 22, 1976

[54] MALLET GAME

[76] Inventor: David C. Harvey, Jr., 1801-12th St., Phenix City, Ala. 36867

[22] Filed: Apr. 28, 1975

[21] Appl. No.: 572,461

[52] U.S. Cl. ..... 273/138 R; 273/115; 273/130 B

[51] Int. Cl.[2] ..... A63F 7/04

[58] Field of Search ..... 273/138 R, 144 B, 145 C, 273/145 CA, 145 D, 130 B, 119 R, 101, 113, 115, 67 R, 67 C, 145 R, 145 A

[56] References Cited

UNITED STATES PATENTS

| | | | |
|---|---|---|---|
| 434,613 | 8/1890 | Turner | 273/145 C |
| 693,821 | 2/1902 | DeFord | 273/138 R |
| 2,060,463 | 11/1936 | Gessler | 273/145 A |
| 2,788,974 | 4/1957 | Pick | 273/115 |
| 3,204,345 | 9/1965 | Buckner | 273/145 C X |
| 3,269,732 | 8/1966 | MacPherson | 273/145 A |

FOREIGN PATENTS OR APPLICATIONS

| | | | |
|---|---|---|---|
| 1,383,479 | 11/1964 | France | 273/145 C |
| 1,077,300 | 4/1954 | France | 273/144 B |
| 397,356 | 5/1909 | France | 273/145 C |
| 245,022 | 2/1926 | Italy | 273/145 C |

*Primary Examiner*—Richard C. Pinkham
*Assistant Examiner*—Arnold W. Kramer
*Attorney, Agent, or Firm*—H. C. Hogencamp

[57] ABSTRACT

A mechanical apparatus for playing a game of chance for entertainment. By manipulation of a mallet-like device a resilient ball is caused to bounce about within a hollow open-space, then settle into any one of nine indentures in a scoring face which is marked to represent a tic-tac-toe board. A matching tic-tac-toe score card for marking results and determining the winner of the game may be included. Although designed primarily as a toy for children, it has appeal to those of all ages.

1 Claim, 5 Drawing Figures

MALLET GAME

This invention relates to a new and improved game of chance and more specifically to the construction details of the mechanical device employed for playing this game.

While particularly desirable as a toy for the entertainment of children, my game also has appeal for grown-ups.

I choose to call this a MALLET GAME and also include herein suggested rules for playing this game, with scoring variations, as well as a description of the apparatus.

Tic-tac-toe in its basic form is a simple, universally well-known, game which is understood and played by people of all ages from small children to the elderly. Generally just four straight lines are drawn on a piece of paper in such manner as to form 9 squares. Two opponent-contestants alternately mark X's or O's in chosen open squares. The one first connecting three of the nine squares in a straight line — horizontally, vertically or diagonally — without being blocked by his opponant — wins the game; and the game is often repeated time-after-time to provide enjoyable entertainment.

Tic-tac-toe is so popular and so appealing that it has even been incorporated into a daily television show.

My MALLET GAME provides a novel and attractive way of playing this game, using a new and improved mechanical apparatus therefor. In my game the selection of squares becomes primarily that of a game of chance rather than that of choice. Additionally, variations in scoring can be employed in order to play other similar games on this same apparatus.

Although here called a game of chance, it is possible that some skill could also become involved — as by "jiggling" the mallet somewhat as is done with pin ball machines to influence a ball in finding an opening to settle into.

Obviously, although herein designated simply as a MALLET GAME, my device could be merchandised under some other attractive trade name without impairing or limiting the scope of my invention.

The primary object of the present invention is to provide a new and improved construction for a device with which to play a game of chance for entertainment purposes.

Other objects will become apparent from the following description, the accompanying drawing, and the appended claim.

Figure 3:
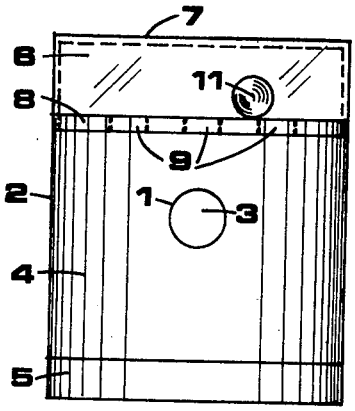

FIG. 3 an end view; and

Figure 1:
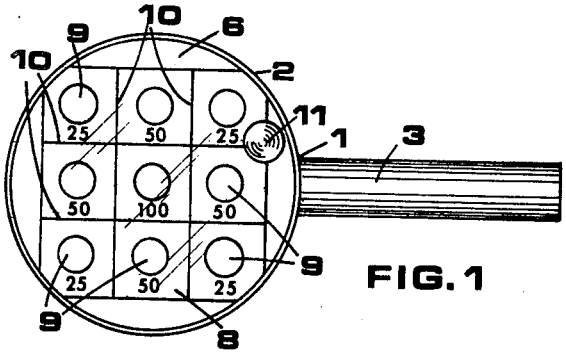
FIG. 1 is a top plan view of the game device, showing the scoring face.
Figure 4:
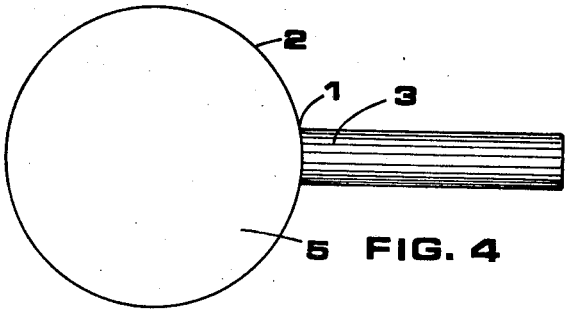

FIG. 4 a bottom view of the device shown in FIG. 1.

Figure 5:
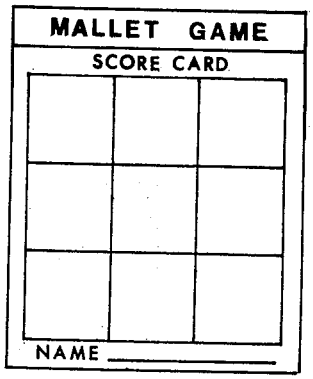

FIG. 5 is a sketch representative of a score card such as might well be used in playing the game.

Referring to the drawings is more detail, like reference figures designating like parts:

FIGS. 1, 2, 3, and 4 can, in effect, be construed as working drawings for construction of my game device, lacking only actual dimensions and proportion. These FIGS. show, respectively, top, side, end, and bottom plan views of the complete device which is designated as 1.

From the drawing it will be seen that basically my device 1 has the outward appearance of a mallet as the name of the game implies and consists of a round, cylindrically shaped, mallet-head 2 having a firmly attached handle 3 protruding outwardly from and normal thereto. Handle 3 is most simple in structure but mallet-head 2 is comprised of several sub-parts.

Figure 2:
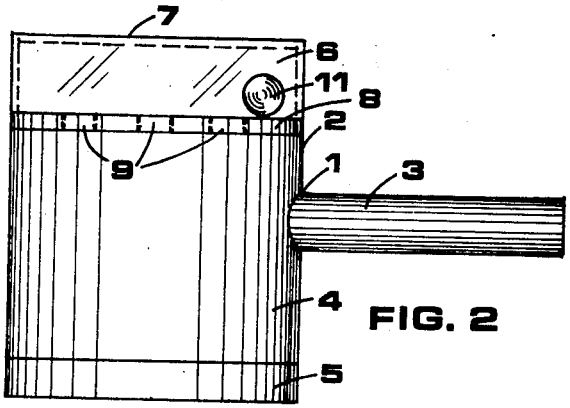
FIG. 2 is a side view.

The major central section 4 of mallet-head 2 can be of solid construction and might conveniently be tubular and made of wood, plastic, or metal. A resilient rubber or plastic disc section 5 is firmly affixed to central section 4 at its lower end as shown in FIGS. 2, 3 and 4 by cementing or other such effective means.

In order to simplify the drawing and this explanation thereof, mallet-head 2 is depicted as having a hollow, open-space upper portion 6 of transparent material protruding above and firmly affixed to central section 4 as a separate entity. The outer periphery of this upper portion 6 need not be transparent and, in fact, could simply be an extension of and an integral part of central section 4 if this section is tubular. However, in either case, the flat top surface 7 of mallet-head 2 should be of clear transparent plastic material so that the hollow open space within said upper portion 6 and its contents can be viewed therethrough.

Although the structure of mallet 1 as thus described provides the energizing force of the device, the scoring face 8 with its components, as particularly shown in FIG. 1, in co-operation with ball 11, also shown in FIG. 1, is operationally of the greatest importance in playing the game.

Scoring face 8 is preferably flat and is firmly positioned to define the bottom of the hollow open-space tubular portion 6 of the mallet 1, in which open space a ball 11 is freely movable. As shown, the transparent viewing surface 7 covers the top of the open-space portion 6. Nine equi-spaced round holes, cups, or indentures designated as 9 are positioned and arranged on scoring face 8 in the manner shown in FIG. 1 in an outwardly square configuration. Indentures 9 are formed in scoring face 8 as by drilling or molding in plastic to be of proper size, relative to the size of ball 11, to provide a cup or opening for ball 11 to conveniently settle into without falling through. Straight marker lines 10 placed intermediate of indentures 9 give the scoring face 8 the appearance of a tic-tac-toe board composed of nine squares and it can be so used for scoring. Additionally, and in order to provide another method of scoring and a variation of the game, each substantially square space defined by lines 10 has marked therein a selected number such as 25 — 50 — 100.

The ball 11 could even be a ball-bearing or a glass marble but preferably is made of a soft resilient material such as rubber or a suitable synthetic rubber or plastic so that it will bounce freely within the hollow open space 6 and so that it will not scratch or otherwise mar the top transparent surface 7 through which the scoring face 8 and the ball 11 is viewed. Although the actual size of the ball 11 is not important, it should be kept proportionate and, as previously stated, the relative size of ball 11 and indentures 9 should be such that they are co-operative: i.e. — so that the ball will be readily accommodated by the indentures.

The scorecard depicted in FIG. 5 is self-explanatory without further description. As here shown in printed form this scorecard is simply the usual nine-square tic-tac-toe board as so frequently drawn with four lines on a piece of scrap paper. Although it is contemplated that such scorecards, or pads of these scorecards, might be supplied in the MALLET GAME package, it is shown here as simply descriptive. The home-drawn four-line pencilled boards as drawn on scratch paper and used in the common X and O tic-tac-toe game can equally well be employed for scoring. This also applies in the BLACKOUT version of the game as later described in the suggested RULES.

Operation of my MALLET GAME apparatus is very simple:

Stand the mallet 1, resilient disc 5 down and transparent viewing surface 7 up, on a table-top or other flat surface. Lift the mallet up by its handle 3 and strike it down — gently — on the table-top. The ball 11 will bounce up from the scoring face 8, return to it (after perhaps bouncing up and down several times within the hollow space 6 in which it is contained), and settle into one of the cups or indentures 9 in scoring face 8. Sometimes a little "jiggling" helps the ball to find a place in one of the cups; however, as soon as the ball is settled in a cup the player should release his hold on the handle and not further move the mallet. The scorecard should then be marked to correspond with the square on the scoring face which contains the cup into which the ball 11 has settled.

Scoring procedure and operation is basically explained in the following suggested RULES. It is contemplated that a printed copy of these instructions and rules will be packaged with the MALLET GAME when it is merchandised. Any one of at least three games or methods of keeping the score of the players and thereby determining the winner may be used.

RULES FOR PLAYING MALLET GAME (Three score methods)

TIC-TAC-TOE — 2 players

1. A single TIC-TAC-TOE scorecard is used.
2. The MALLET is placed on a flat surface with soft surface down and clear transparent surface up.
3. The first player lifts up MALLET by the handle, then strikes it back down lightly and the ball bounces up, then settles back down into a cup in the scoring face.
4. Whichever square in the TIC-TAC-TOE scorecard that is the same as the one on the scoring face that the bouncing ball goes into is initialled (or marked with an X or an O) by the player who used the MALLET.
5. The second player takes his turn.
6. This is repeated — First player, then second player taking turns.
7. The player who can first initial or mark three squares in a row — straight across, up and down, or diagonally, as in TIC-TAC-TOE, wins the game.
8. Variations — Modifications — If either player places the ball in the hole in a square that has already been initialled or marked by himself or by the other player, he loses this chance and does not score-OR-he can cancel the other player's mark on the scorecard and place his own mark in that square. This must be decided on before game is started.

BLACKOUT (or FILL THE SCORECARD) — Any number of players

1. Each player gets his own TIC-TAC-TOE scorecard.
2. Each player marks only his own scorecard.
3. This game is played the same as TIC-TAC-TOE except the first player to get the ball in every hole and so mark or black out his scorecard wins the game.

500 – Any number can play

1. The score for each player is kept separately on any piece of paper.
2. The score number printed in the square in which the ball goes in hole is marked down for the player whose turn it is to strike down the MALLET.
3. The first player whose total score reaches 500 is the winner.

Any agreed on way can be used to choose the starting player to begin the first game. After the first game either the winner or the loser can start the next game — as previously decided on — or players can alternate as starters.

Scores of how many games each player wins can be kept to decide the 2 out of 3 or 3 out of 5 final winner.

It is foreseen that manufacturing techniques and processes, especially for potential economical mass production, might necessarily entail some variations in structure and materials without change in the basic design and concepts of this invention and without limiting its scope.

Having thus described my invention, with accompanying drawing, what I claim as new and desire to protect by Letters Patent is:

1. A mallet-like device for playing a game of chance comprising, in combination: a mallet-head of elongated substantially cylindrical outward shape having flat circularly shaped enclosed ends and including a central section of solid material, a lower section of resilient material firmly affixed thereto, and a hollow open-space portion at the upper end of said central section and having a flat imperforate clear transparent top surface thereon; a flat scoring face having nine equi-spaced ball-receiving indentures therein, arranged in an outwardly square formation firmly positioned within and delineating the bottom of said open-space upper portion and viewable through the transparent upper surface thereof; a handle firmly attached to said central section of said mallet-head and extending outwardly normal therefrom; and a ball freely movable within said open-space upper portion of said mallet-head and viewable through the transparent top surface thereof.

* * * * *